US008113884B2

(12) United States Patent
Matsuzaki et al.

(10) Patent No.: US 8,113,884 B2
(45) Date of Patent: Feb. 14, 2012

(54) CONNECTOR

(75) Inventors: Shinichi Matsuzaki, Kanagawa (JP); Hitoshi Suzuki, Kanagawa (JP)

(73) Assignee: IRISO Electronics Co., Ltd. (JP)

( * ) Notice: Subject to any disclaimer, the term of this patent is extended or adjusted under 35 U.S.C. 154(b) by 0 days.

(21) Appl. No.: 12/447,147

(22) PCT Filed: Oct. 18, 2007

(86) PCT No.: PCT/JP2007/070320

§ 371 (c)(1),
(2), (4) Date: Apr. 24, 2009

(87) PCT Pub. No.: WO2008/050665

PCT Pub. Date: May 2, 2008

(65) Prior Publication Data

US 2010/0029134 A1 Feb. 4, 2010

(30) Foreign Application Priority Data

Oct. 25, 2006 (JP) ..... 2006-289978

(51) Int. Cl.
*H01R 9/03* (2006.01)

(52) U.S. Cl. ..... 439/607.57

(58) Field of Classification Search ..... 439/607.57, 439/247, 74, 31, 83, 660, 248
See application file for complete search history.

(56) References Cited

U.S. PATENT DOCUMENTS

| | | | | |
|---|---|---|---|---|
| 4,824,384 | A * | 4/1989 | Nicholas et al. | 439/108 |
| 4,971,565 | A * | 11/1990 | Fox, Jr. | 439/74 |
| 5,181,855 | A * | 1/1993 | Mosquera et al. | 439/74 |
| 5,516,303 | A * | 5/1996 | Yohn et al. | 439/248 |
| 5,556,286 | A * | 9/1996 | Ikesugi et al. | 439/74 |
| 5,575,690 | A * | 11/1996 | Eaton | 439/717 |
| 6,095,830 | A * | 8/2000 | Hirata et al. | 439/101 |
| 6,402,566 | B1 * | 6/2002 | Middlehurst et al. | 439/699.1 |
| 6,927,974 | B2 * | 8/2005 | Robillard et al. | 361/679.4 |
| 7,510,445 | B2 * | 3/2009 | Tokunaga | 439/634 |

FOREIGN PATENT DOCUMENTS

| | | |
|---|---|---|
| JP | 10-208816 | 8/1998 |
| JP | 11-233201 | 8/1999 |
| JP | 2002-246119 | 8/2002 |
| JP | 2003-173847 | 6/2003 |
| JP | 2003-217746 | 7/2003 |
| JP | 2005-251461 | 9/2005 |

* cited by examiner

*Primary Examiner* — Jean F Duverne

(74) *Attorney, Agent, or Firm* — Lowe Hauptman Ham & Berner, LLP

(57) ABSTRACT

A connector capable of easily forming shield members which can be attached to a housing comprises a socket capable of fitting into the plug, plural socket terminals capable of electrically connecting the plug when the plug fits into the socket, a pair of tabular first socket side shield members covering the front face portion and the back face portion of the socket respectively, and a pair of the first attachment grooves respectively at both ends in the width direction of the front and the back face portions. The first attachment grooves can be inserted into and hold both ends in the width direction of the first socket side shield members. Therefore, it becomes possible to attach the first socket side shield members without having a lock piece, etc., at the first socket side shield members. The first socket side shield members can be formed easily.

8 Claims, 6 Drawing Sheets

CONNECTOR

RELATED APPLICATIONS

The present application is based on, and claims priority from, JP Application Number 2006-289978, filed Oct. 25, 2006, and PCT Application Number PCT/JP07/070,320, filed Oct. 18, 2007, the disclosures of which is hereby incorporated by reference herein in their entireties.

BACKGROUND OF THE INVENTION (i) Field of the Invention

The present invention relates to a connector mounted on a printed-circuit board or the like to be used for connecting a plurality of circuit boards electrically.

(ii) Description of the Related Art

Generally, as such type of connectors, a connector is known to comprise a housing formed so as to be capable of fitting into a connection object, a plurality of terminals formed so as to be capable of electrically connecting the connection object when the connection object fits into the housing, and a shield member provided so as to cover the outer surface of the housing and be capable of attaching to the housing (See Patent Document 1, for example).

However, with this connector, a lock piece which extends a direction perpendicular to an attaching direction is provided at the shield member, and the shield member is attached at the housing by inserting the lock piece into a lock portion which is provided at the housing. In this case, it becomes necessary to manufacture the shield member and the housing anew, respectively. Therefore, as a result, it is concerned that this increases the cost of manufacturing connectors.

Patent Document 1: Japanese Patent Publication No. 2005-251461

DISCLOSURE OF THE INVENTION

Problems to be Solved by the Invention

The present invention was made in view of the above problems and has an object to provide a connector capable of easily forming shield members which are capable of attaching to a housing.

Means for Solving the Problems

In order to achieve the above object, the present invention comprises a housing formed so as to be capable of fitting into a connection object, a plurality of terminals formed so as to be capable of electrically connecting the connection object when the connection object fits into the housing, a pair of tabular shield members provided so as to cover two surfaces of the outer surface of the housing respectively, the said two surfaces being along the arranged direction of terminals, and a pair of attachment grooves provided at the predetermined end of the said two surfaces respectively, the said attachment grooves formed so as to be capable of inserting and holding the end of the shield members.

By this, the end of tabular shield members provided so as to cover two surfaces of the outer surface of the housing respectively are held by the attachment grooves, therefore, it becomes possible to attach the shield member on the housing without providing the lock piece etc. at the shield member.

Advantages of the Invention

According to the present invention, it becomes possible to attach the shield member on the housing without providing the lock piece etc. at the shield member, therefore, the shield member can be formed easily. Therefore, it becomes possible to manufacture the connector at low cost.

DESCRIPTION OF THE SYMBOLS

1 . . . socket, 2 . . . plug, 11 . . . a front face portion, 12 . . . a back face portion, 13 . . . the both side face portions in width direction, 16*a* . . . a pair of the first attachment grooves, 17*a* . . . a pair of the second attachment grooves, 30 . . . a plurality of socket terminals, 40 . . . a pair of the first socket side shield members, 50 . . . a pair of the second socket side shield members, 51 . . . a pair of contact pieces.

DESCRIPTION OF THE PREFERRED EMBODIMENTS

Figure 1:
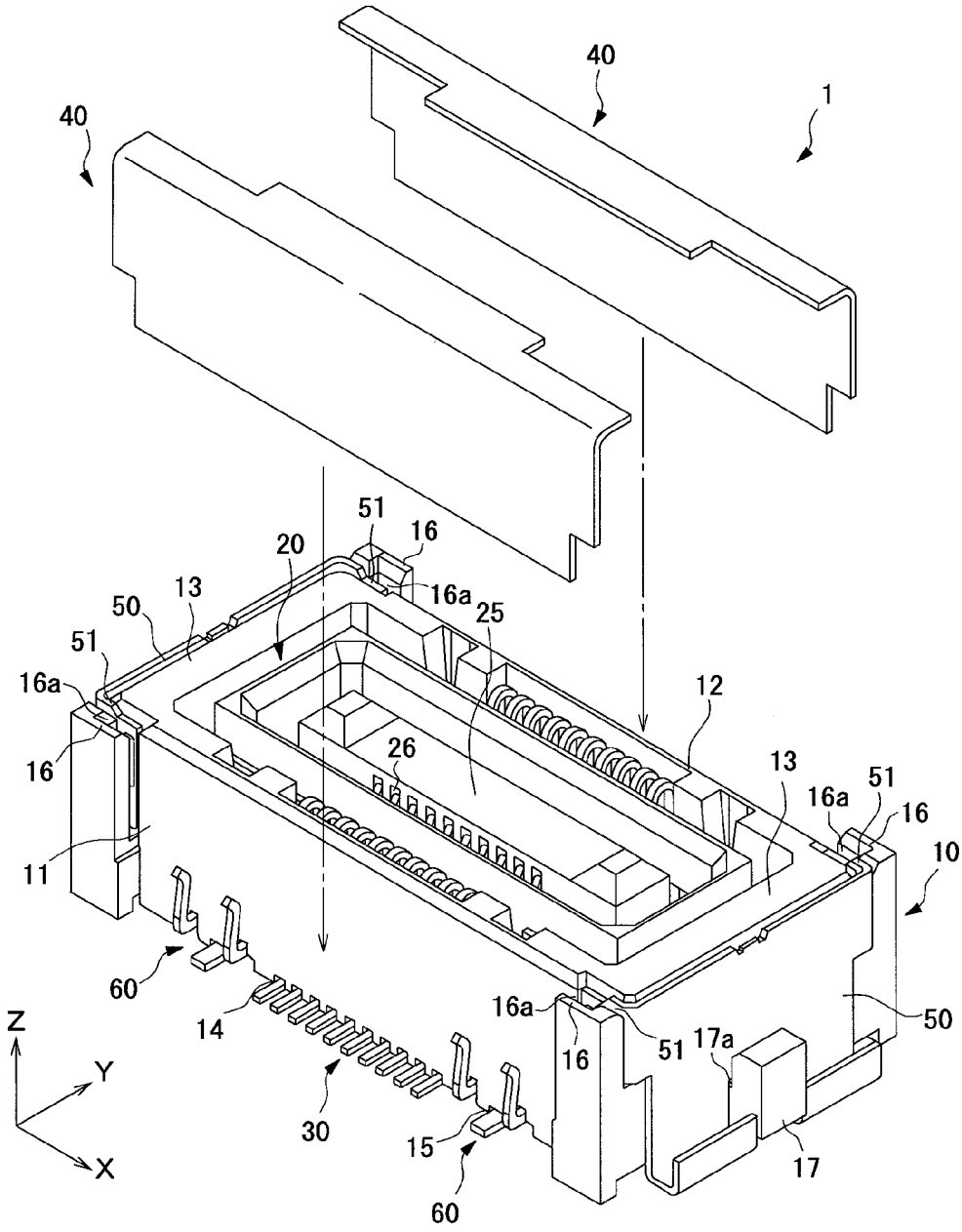
FIG. 1 is a perspective view of a socket according to an embodiment of the present invention.
Figure 2:
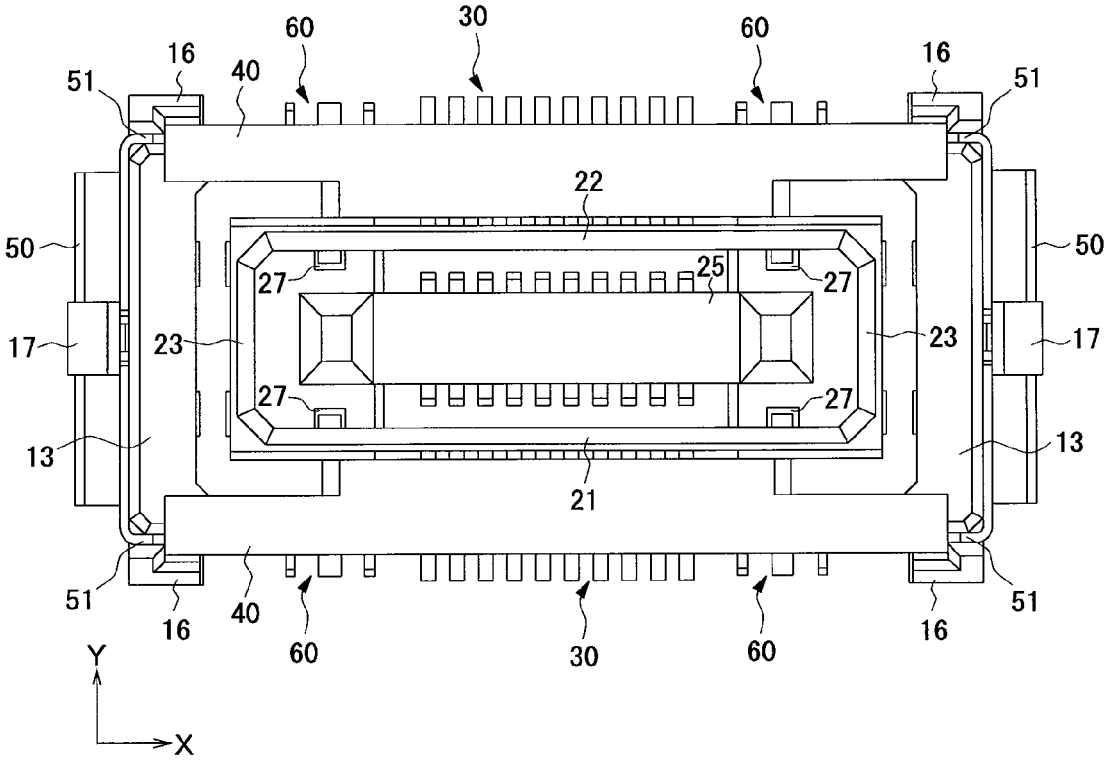
FIG. 2 is a plan view of the socket.
Figure 3:
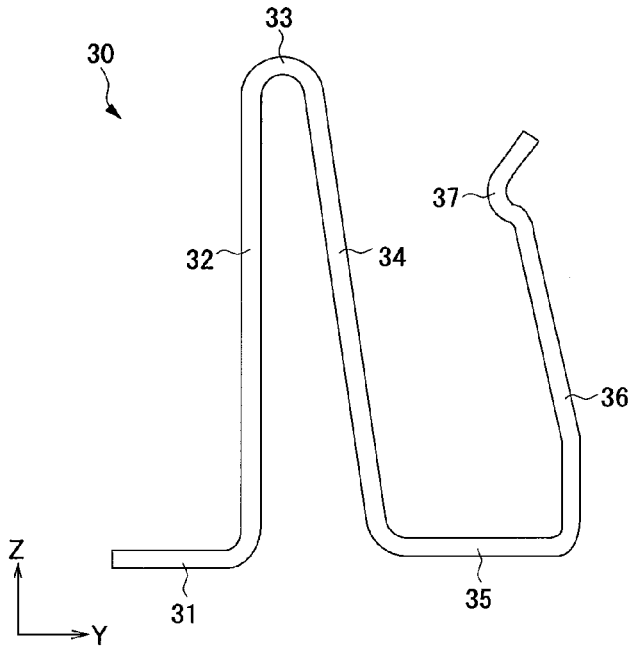
FIG. 3 is a side view of a socket terminal.
Figure 4:
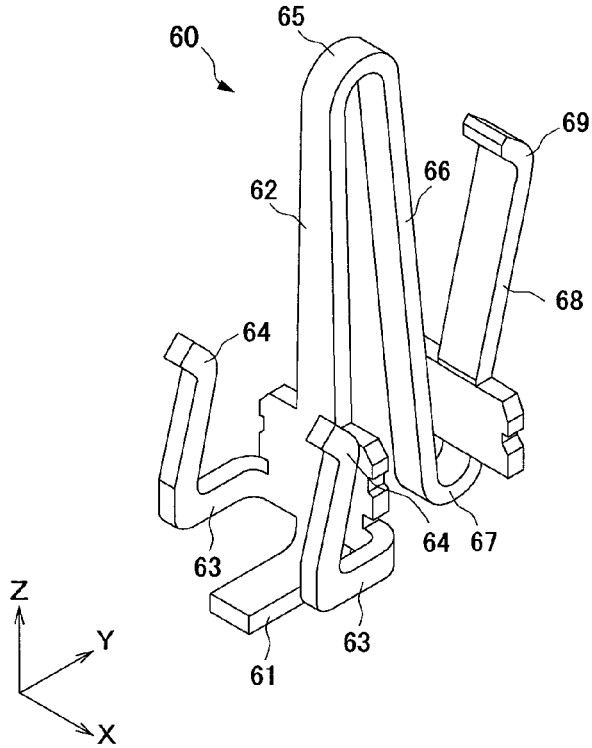
FIG. 4 is a perspective view of a shield terminal.
Figure 5:
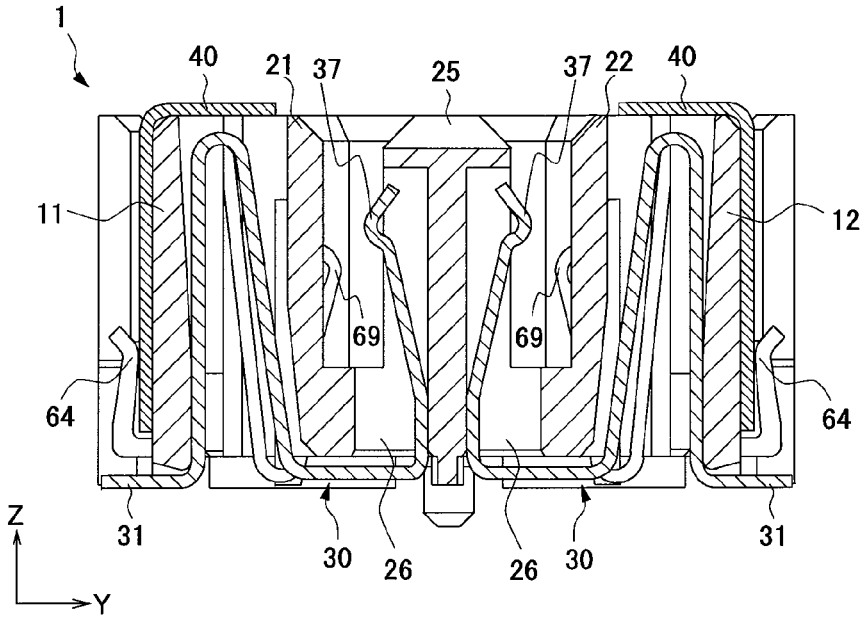
FIG. 5 is a side sectional view of the socket.
Figure 6:
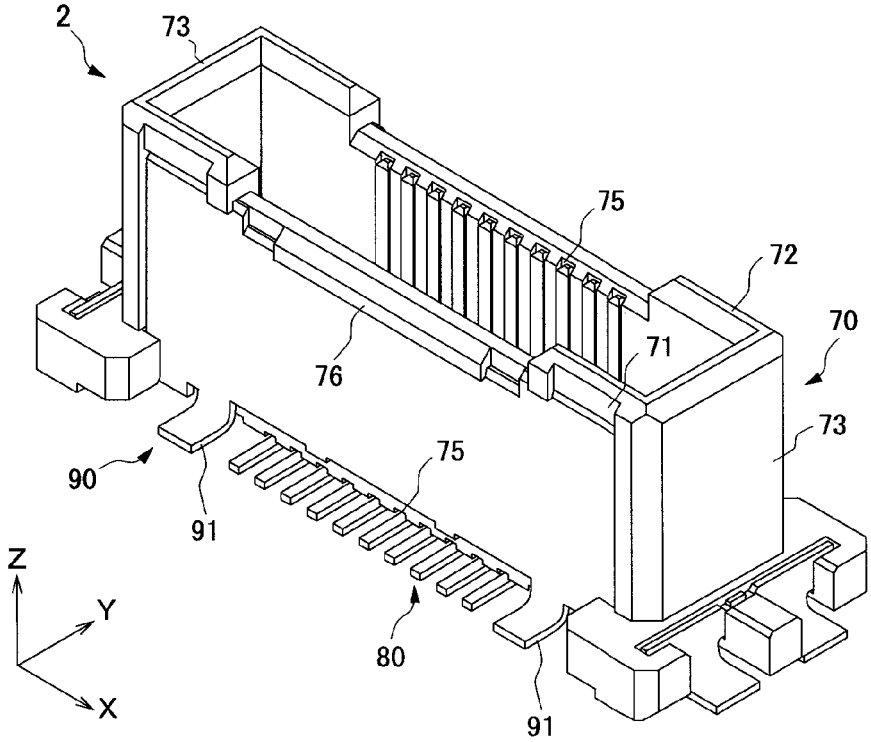
FIG. 6 is a perspective view of a plug according to the embodiment of the present invention.
Figure 7:
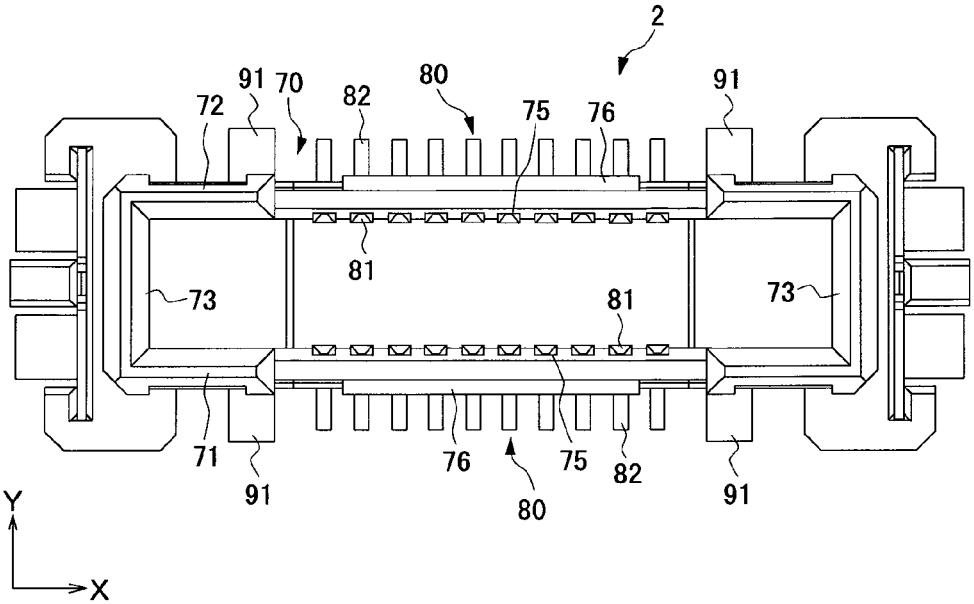
FIG. 7 is a plan view of the plug.
Figure 8:
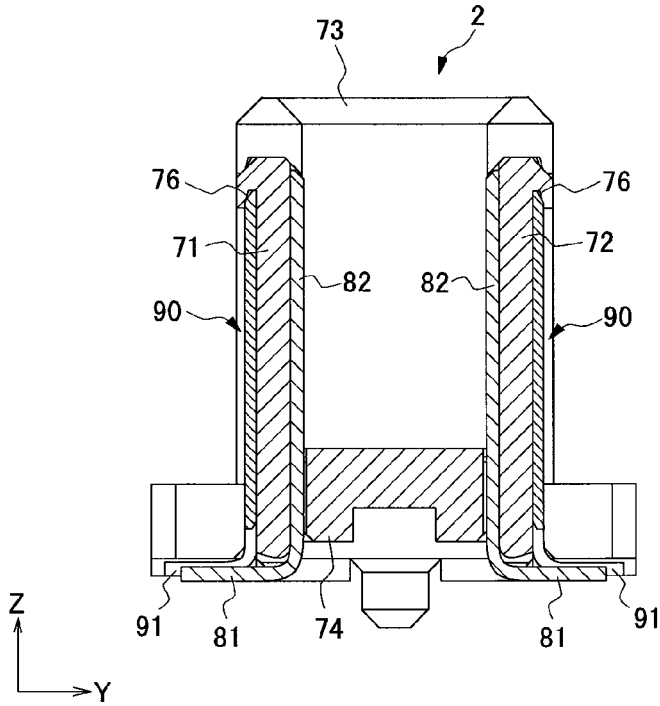
FIG. 8 is a side sectional view of the plug.
Figure 9:
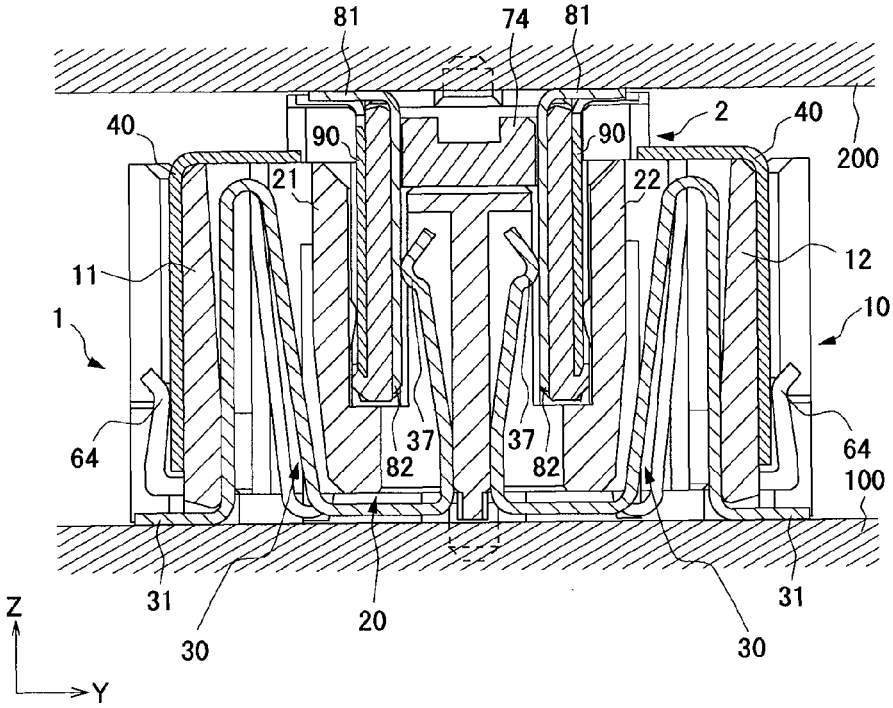
FIG. 9 is a side sectional view showing an operation when the socket and plug are fitted together.
Figure 10:
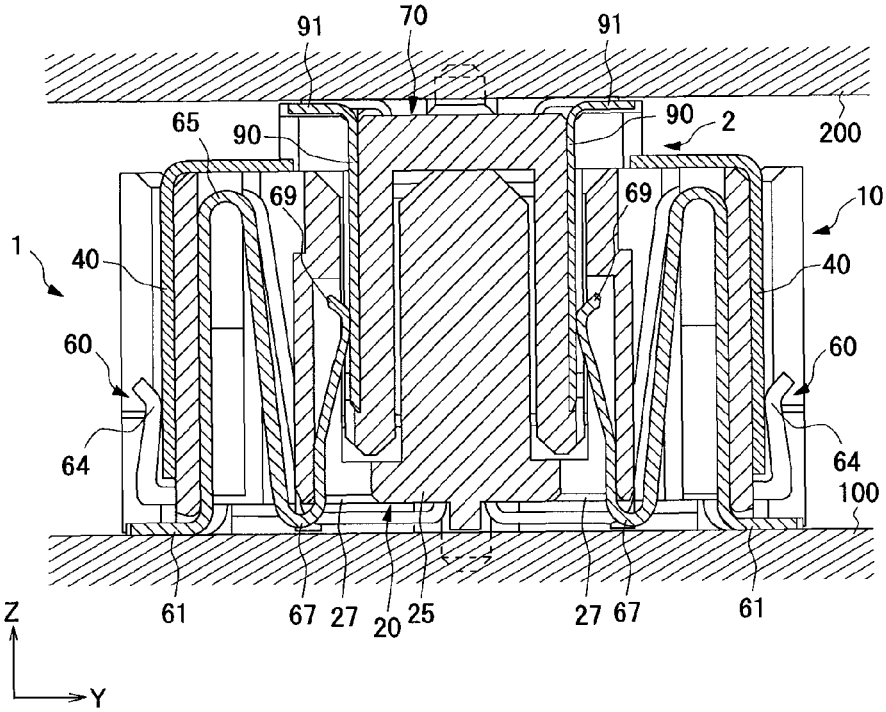
FIG. 10 is a side sectional view showing an operation when the socket and plug are fitted together.

FIG. 1 to 10 show an embodiment of the present invention. FIG. 1 is a perspective view of a socket, FIG. 2 is a plan view of the socket, FIG. 3 is a side view of a socket terminal, FIG. 4 is a perspective view of a shield terminal, FIG. 5 is a side sectional view of the socket, FIG. 6 is a perspective view of a plug, FIG. 7 is a plan view of the plug, FIG. 8 is a side sectional view of the plug, FIGS. 9 and 10 are a side sectional view showing an operation when the socket and plug are fitted together.

This connector comprises a socket 1 as a housing arranged on a first circuit board 100. The connector is used to connect the circuit boards 100 and 200 electrically each other by fitting the socket 1 into a plug 2 as a connection object arranged on a second circuit board 200.

As is shown in FIGS. 1 and 2, the socket 1 comprises a socket side fixed housing 10 which is arranged on the first circuit board 100 side, a movable housing 20 which is provided so as to be movable in the width direction (X direction in the figure) and the back-and-forth direction (Y direction in the figure) with respect to the socket side fixed housing 10, a plurality of socket terminals 30, one end of which is held by the socket side fixed housing 10 and the other end of which is held by the movable housing 20, the socket terminals 30 are formed so as to be elastic deformed in accordance with movement of the movable housing 20 with respect to the socket side fixed housing 10, a pair of first socket side shield members 40 as shield members which are provided so as to cover two surfaces of the outer surface of the first housing respectively, the said two surfaces are along the arranged direction of socket terminals 30, more specifically, the said two surfaces are along the width direction, a pair of second socket side shield members 50 as other shield members which are provided so as to cover the other two surfaces of the outer surfaces of the socket side fixed housing 10 respectively, the said other two surfaces are perpendicular to the arranged direction of the socket terminals 30, in other word, the said other two surfaces are along the back-and-forth direction, and a pair of shield terminals 60 formed so as to be detachable from the first socket side shield members 40 respectively.

A socket side fixed housing 10 is made of a synthetic resin molding and is formed a rectangular tube shape of which the upper and bottom faces are open. More specifically, the socket side fixed housing 10 comprises a front face portion 11 and a back face portion 12, which extend in the width direction respectively, and the both side face portions in width direction 13 which extend in the back-and-forth direction. On the bottom end side of the front face portion 11 and back face portion 12, a plurality of terminal holes 14 which hold one side of each socket terminal 30 is provided at even intervals with each other. Also, on the both end sides in the arranged direction of the terminal holes 14 (X direction in the figure), a pair of shield terminal holes 15 are provided so as to hold shield terminals 60 respectively. On the both end sides of the front face portion 11 and the back face portion 12 in the width direction, a pair of the first attaching portions 16 to mount the first socket side shield members 40 are provided. On the top of the first attaching portions 16, the first attachment groove 16*a* is provided so as to be capable of holding the end in the width direction of the first socket side shield members 40 inserted from above. The first attachment groove 16*a* is formed so as to extend in the width direction. On the bottom of the both side face portions in width direction 13, a pair of the second attaching portions 17 to mount the second socked side shield members 50 are provided. The second attaching portions 16 are formed so as to protrude outside in the width direction of the socket side fixed housing 10. On the top of the second attaching portions 17, the second attachment groove 17*a* is provided so as to be capable of holding the bottom end of the second socket side shield members 50. The second attachment groove 17*a* is formed so as to extend downward.

A movable housing 20 is made of the synthetic resin molding and is formed to a box shape of which the upper face is open. More specifically, the movable housing 20 comprises a front face portion 21, a back face portion 22, the both side face portions 23 in the width direction, and a bottom face portion 24. A fitting portion 25 is provided at the center of the bottom face portion 24, the fitting portion 25 is formed so as to be protruded upward. Also, on a side wall portion of the front face and the back face side of the fitting portion 25, a plurality of terminal holes 26 which hold the other side of the socket terminals 30 are formed so as to penetrate through the bottom face portion 24 in the up-and-down direction (Z direction in the figure). Moreover, on the back-and-forth direction both end sides of the bottom face portion 24, a pair of through-holes 27 is formed so as to be capable of inserting the other end side of the shield terminals 60 in the up-and-down direction, the through-holes 27 are provided so as to be placed at the both end sides in the arranged direction of the socket terminals 30 respectively.

The socket terminals 30 are made of a conductive metal plate capable of being elastic deformed and arranged in a line on the both sides in the back-and-forth direction of the socket 1 respectively. As is shown in FIG. 3, the socket terminal 30 is formed so that a connection portion 31 extends in the back-and-forth direction, the connection portion 31 is to be connected to the first circuit board 100. Also, the socket terminals 30 comprises a first straight portion 32 which extends upward from the back end of the connection portion 31, a bending portion 33 which is bent downward from the upper end of the first straight portion 32, a second straight portion 34 which extends aslant downward from the bending portion 33, a third straight portion 35 which extends backward from the bottom end of the second straight portion 34, a forth straight portion 36 which extends upward from the back end of the third straight portion 35, and a contact portion 37 which is bent forward from the forth straight portion 36 and extends upward. The socket terminals 30 is capable of being elastic deformed in the width direction and back-and-forth direction with respect to the bending portion 33 as a base point.

The first socket side shield members 40 is made of a conductive metal plate which extends in the width direction of the socket side fixed housing 10 and formed so as to be detachable from the outer surfaces of the front face portion 11 and the back face portion 12 respectively. More specifically, the width direction both end sides of the first socket side shield members 40 are inserted from above into the first attaching portions 16 of the socket side fixed housing 10 respectively so that the first socket side shield members 40 is attached to cover the outer surface in the width direction of the socket side fixed housing 10. Also, the first socket side shield members 40 is formed so that the upper end side thereof covers the front face portion 11 or the back face portion 12 of the socket side fixed housing 10 and formed in approximately L-shape so as to extend to the front face portion 21 or the back face portion 22 of the movable housing 20. In this case, the upper end side of the first socket side shield members 40 covers exposed parts of the socket terminals 30 between the housings 10 and 20 from above. Also, the first socket side shield members 40 can be manufactured easily by a press work of a metal plate, a dimension of which is the same with dimension of the socket side fixed housing 10 in the width direction. Therefore, it is unnecessary to manufacture dies of the first socket side shield members 40 in accordance with dimensions of the socket side fixed housing 10.

The second socket side shield members 50 is made of the conductive metal plate which extends in the back-and-forth direction of the socket side fixed housing 10 and formed so as to cover the outer surfaces of the both side face portions 13 in the width direction respectively. Also, on the both end sides in the back-and-forth direction of the second socket side shield members 50, a pair of contact pieces 51 is provided so as to respectively touch the first shield members which are provided on the front face portion 11 and the back face portion 12. The contact pieces 51 are formed by bending the back-and-forth direction two end sides of the second socket side shield members 50 toward the width direction. Also, as for the second socket side shield members 50, the dimension thereof does not change according to the number of terminals, therefore, it can be manufactured easily by using the same mold.

Shield terminals 60 are made of the conductive metal plate which is capable of being elastic deformed. As is shown in FIG. 4, a ground connect portion 61 capable of electrically connecting to a ground portion (not shown) is formed so as to extend in the back-and-forth direction, the ground portion is provided on the first circuit board 100. Also, each shield terminals 60 is provided with a first straight portion 62 which extends upward from the back end of the ground connect portion 61. On the both end sides in the width direction of the first straight portion 62, second straight portions 63 are provided respectively which extend forward from the first straight portion 62. Also, on the front end of the second straight portions 63, first shield conductive portions 64 which touches the first socket side shield members 40 is provided integrally. Moreover, each shield terminal 60 is provided with a first bending portion 65 which is bent downward from the upper end of the first straight portion 62, a third straight portion 66 which extends aslant downward from the first bending portion 65, a second bending portion 67 which is bent upward from the bottom end of the third straight portion 66, and a fourth straight portion 68 which extends aslant upward from the second bending portion 67. The shield terminals 60 are capable of being elastic deformed in the width direction and the back-and-forth direction with respect to the first and second bending portions 65 and 67 as a base point. Also, on the upper end of the fourth straight portion 68, a second shield conductive portion 69 which touches the later-described plug side shield member 90 is provided integrally.

When the socket terminals 30 are mounted on the socket side fixed housing 10, the socket terminals 30 are pressed into the terminal holes 14 from below. At this time, as is shown in FIG. 5, one end side of the socket terminals 30, in other word, the upper end side of the connect portion 31 is held by the terminal holes 14. Also, when the movable housing 20 is pressed in from above with respect to the other end side of the socket terminals 30, the fourth straight portion 36 and the contact portion 37 of the socket terminals 30 penetrate through the bottom face portion 24 of the movable housing 20 and held by terminal holes 26.

Also, when the first socket side shield members 40 are mounted on the socket 1, the both end sides in the width direction of the first socket side shield members 40 are inserted into the first attachment grooves 16*a* of the front face portion 11 and the back face portion 12 from above. In addition, when the second socket side shield members 50 are mounted on the socket 1, the contact pieces 51 of the second socket side shield members 50 are inserted into the first attachment grooves 16*a* from above. In this case, the contact pieces 51 contact with the first socket side shield members 40 which are mounted on the front face portion 11 and the back face portion 12 respectively. Also, the second socket side shield members 50 are held by inserting the bottom side of which into the second attachment groove 17*a*.

Additionally, when the shield terminals 60 are mounted on the socket 1, the shield terminals 60 are pressed into shield terminal holes 15 from below. At this time, the top end side of the ground connect portion 61 and the top end side of the second straight portions 63 are held by the shield terminal holes 15 and the first shield conductive portion 64 touches the first socket side shield members 40. Also, the shield terminals 60 are held in a state that the fourth straight portion 68 and the second shield conductive portion 69 penetrate upward through through-holes 27 of the movable housing 20. In this case, the outer surfaces in the width direction and back-and-forth direction of the socket side fixed housing 10 are covered by the shield members 40, 50, thus, it will be capable of reducing the effect of electromagnetic wave to the socket terminals 30 from the outside. Also, the first and the second shield conductive portions 64, 69 of the shield terminals 60 are arranged on the both end sides in the arranged direction of the socket terminals 30 so as to completely prevent the shield contact portions 64, 69 from obstructing springy deformation of the socket terminals 30.

Next, a composition of the plug 2 is explained. As is shown in FIGS. 6 and 7, the plug 2 is provided with a plug side fixed housing 70 arranged at the second circuit board 200 side, a plurality of plug terminals 80 formed so as to be held by the plug side fixed housing 70, and a pair of plug side shield members 90 formed so as to cover the outer surfaces in the width direction of the plug side fixed housing 70 respectively.

The plug side fixed housing 70 is made of the synthetic resin molding and is formed to a box shape of which the upper face is open. More specifically, the plug side fixed housing 70 comprises a front face portion 71, a back face portion 72, both side face portions 73 in the width direction, and a bottom face portion 74. The plug side fixed housing 70 is provided so as to be movable with respect to the socket side fixed housing 10 of the socket 1 and formed so as to be capable of fitting into the movable housing 20. Also, at the bottom end sides and the inner wall portions of the front face portion 71 and the back face portion 72 of the plug side fixed housing 70, a plurality of the terminal holes 75 which hold the plug terminals 80 are provided at even intervals each other respectively. Moreover, on the upper end sides of the front face portion 71 and the back face portion 72, attaching portions 76 are formed respectively so on which the plug side shield members 90 are mounted. The attaching portions 76 comprise a first attachment groove 76*a* formed so as to be capable of inserting the center part of the upper side of the plug side shield member 90 from below and holding it, and a pair of the second attachment grooves 76*b* formed so as to be capable of inserting the both sides in the width direction of top of the plug side shield member 90 from below and holding them. The first attachment groove 76*a* is provided so as to be located under the second attachment grooves 76*b*.

The plug terminals 80 are made of the conductive metal plate and arranged in a line on the both sides in back-and-forth direction of the plug 2. As is shown in FIG. 8, the plug terminals 80 are formed so that a connect portion 81 extends in the back-and-forth direction, the connect portion 81 is to be connected to the second circuit board 200. A contact portion 82 which extends upward is provided at one end side of the connect portion 81.

Plug side shield members 90 are made of a conductive metal plate which extends in the width direction of the plug side fixed housing 70, the upper end side thereof are pressed into the mounting grooves 76 of the plug side fixed housing 70 from the below so that the plug side shield members 90 are mounted on to cover the outer surfaces of the plug side fixed housing 70 in the width direction. Also, at the bottom end side of the width direction both end sides of the plug side shield members 90, a ground connect portion 91 capable of electrically connecting to a ground portion (not shown) is formed so as to extend in the back-and-forth direction, the ground connect portion 91 is provided on the second circuit board 200.

When the plug terminals 80 are mounted on the plug side fixed housing 70, the plug terminals 80 are pressed into the terminal holes 75. At this time, as is shown in FIG. 8, the connect portion 81 and contact portion 82 of the plug terminals 80 are held by the terminal holes 75 of the plug side fixed housing 70. Also, when the plug side shield members 90 are mounted on the plug side fixed housing 70, the upper side of the plug side shield members 90 are inserted into the attachment grooves 76*a*, 76*b* from below. In this case, the width direction of the plug side fixed housing 70, in other word, the outer surfaces of the front face portion 71 and the back face portion 72 are covered by the plug side shield members 90, thus, it becomes capable of reducing the effect of electromagnetic wave to the plug terminals 80 from the outside.

The connector which is composed as above is used to connect the pair of the circuit boards 100, 200 electrically. As is shown in FIG. 9, when the plug 2 connected to the second circuit board 200 is arranged above the socket 1 connected to the first circuit board 100, and if the plug 2 is moved downward so that the plug side fixed housing 70 fits into the fitting portion 25 of the movable housing of the socket 1, the contact portion 82 of the plug terminals 80 touches the contact portion 37 of the socket terminals 30 respectively. In this case, as is shown in FIG. 10, the first shield conductive portion 64 of the shield terminals 60 touches the first socket side shield member 40, and the second shield conductive members 69 touches the plug side shield members 90. At this time, if either one of the socket side fixed housing 10 or the plug side fixed housing 70 moves in the width direction or back-and-forth direction with respect to the other, the socket terminals 30 and shield terminals 60 erastically deform by the said movement and a relative positional shift of the fixed housings 10, 70 will be allowed.

Also, to change the number of the terminals 30, 80 without changing intervals between the terminals 30 and 80, it becomes necessary to make the dimensions larger in the width direction, more specifically, the terminal arranged direction of the housings 10, 20, 70. In this case, by mounting the first shield members 40 and plug side shield members 90 according to dimensions thereof on the housings 10, 70 respectively, it becomes capable of covering the shield members 40, 90 of the terminals 30, 80 respectively and reducing the effect of electromagnetic wave to the terminals 30 and 80 from the outside.

As such, according to the connector of the present embodiment, the connector comprises the socket 1 formed so as to be capable of fitting into the plug 2, a plurality of socket terminals 30 formed so as to be capable of electrically connecting the plug 2 when the plug 2 fits into the socket 1, the pair of tabular first socket side shield members 40 provided so as to cover the front face portion 11 and the back face portion 12 of the socket 1 respectively, and the pair of the first attachment grooves 16*a* provided at the both ends in the width direction of the front face portion 11 and the back face portion 12 respectively, the first attachment grooves 16*a* formed so as to be capable of inserting and holding the both ends in the width direction of the first socket side shield members 40. Therefore, it becomes possible to attach the first socket side shield members 40 on the socket 1 without providing the lock piece etc. at the first socket side shield members 40. Thus, the first socket side shield members 40 can be formed easily, it becomes possible to manufacture the connector at low cost.

Also, the connector further comprises the pair of the second socket side shield members 50 provided so as to cover the both side face portions in width direction 13 of the socket 1 respectively, and a pair of the second attachment grooves 17*a* provided at the bottom of the both side face portions in width direction 13 respectively, the second attachment grooves 17*a* formed so as to be capable of inserting and holding the bottom end of the second socket side shield members 50. Thus, for example, in case the dimension of the socket 1 in the arranged direction of the socket terminals 30 varies from the number of terminals, it becomes possible to mount the first shield members 40 which are formed in accordance with the dimension of the socket 1 in the arranged direction on the front face portion 11 and the back face portion 12 respectively, and to mount the second shield members 50, without alteration of the dimension of which, on the both side face portions in width direction 13 respectively. Therefore, even in case the dimension of the socket 1 in the arranged direction of the socket terminals 30 varies from the number of terminals, it becomes possible to form the shield members easily than the case that the outer surface of the socket 1 is covered by one shield member, so it becomes possible to manufacture the shield members at low cost.

Additionally, the first socket side shield members 40 and the second socket side shield members 50 are formed so as to contact with each other, thus, it becomes to ensure an electrical connection between the shield members 40, 50.

Moreover, the above embodiment is nothing but an example and the present invention is not limited to the above embodiment. For example, in the above embodiment, the shield members 40, 50 are formed so as to be capable of inserting from above of the socket 1, however, they can be formed so as to be capable of inserting from below of the socket 1 by providing the attachment grooves 76*a*, 76*b* of the plug 2 on the socket side fixed housing 10.

Also, in the above embodiment, the contact pieces 51 are provided on the second socket side shield members, however, they can be provided on the first socket side shield members.

What is claimed is:

1. A connector comprising:

a housing arranged to fit around a connection object;

a plurality of terminals arranged to be electrically connected to the connection object while the connection object fits into the housing;

first and second tabular shield members covering first and second surfaces of the outer surface of the housing respectively, said first and second surfaces extending in the same direction as the terminals, said shield members comprising conductive metal plates; and a pair of attachment grooves at opposite ends of each of said first and second surfaces respectively, said attachment grooves being arranged to receive and hold the ends of the corresponding shield members.

2. The connector according to claim 1, further comprising;

first and second other shield members for covering first and second other surfaces of the outer surface of the housing respectively, said first and second other surfaces extending perpendicular to the direction the terminals extend; and first and second other attachment grooves at the predetermined ends of said first and second other surfaces respectively, the first and second other attachment grooves being arranged to receive and hold the ends of the first and second other shield members.

3. The connector according to claim 2, wherein:

the tabular shield members and the other shield members are arranged to contact each other.

4. The connector according to claim 1, the tabular shield members being arranged to cover substantially the entirety of the corresponding first and second surfaces of the outer surface of the housing.

5. A connector comprising:

a housing arranged to fit around a connection object;

a plurality of terminals arranged to be electrically connected to the connection object while the connection object fits into the housing;

first and second tabular shield members covering first and second surfaces of the outer surface of the housing respectively, said first and second surfaces extending along a longest side of in the same direction as the terminals, said shield members comprising conductive metal plates; and a pair of attachment grooves at both ends of a longitudinal direction of said first and second surfaces respectively, said attachment grooves being arranged to be inserted into by and hold both ends of a longitudinal direction of the shield members.

6. The connector according to claim 5, further comprising;

first and second other shield members for covering first and second other surfaces of the outer surface of the housing respectively, said first and second other surfaces extending perpendicular to the direction the terminals extend; and first and second other attachment grooves at the predetermined ends of said first and second other surfaces respectively, the first and second other attachment grooves being arranged to be inserted into by and hold the ends of the first and second other shield members.

7. The connector according to claim 6, wherein:

the tabular shield members and the other shield members are arranged to contact each other.

8. The connector according to claim 5, the tabular shield members being arranged to cover substantially the entirety of the corresponding first and second surfaces of the outer surface of the housing.

* * * * *